US005518203A

United States Patent [19]

Annaka et al.

[11] Patent Number: 5,518,203

[45] Date of Patent: May 21, 1996

[54] REWINDING SHAFT OF SLITTING MACHINE

[75] Inventors: Shigeru Annaka, Tokyo; Masao Kakizakai, Saitamaken, both of Japan

[73] Assignees: Yugen-Kaisya Nakadaikinzoku, Tokyo; Kakizakaiseiki Kabusiki-Kaisya, Saitamaken, both of Japan

[21] Appl. No.: 378,801

[22] Filed: Jan. 27, 1995

[51] Int. Cl.[6] ..... B65H 75/24

[52] U.S. Cl. ..... 242/576.1; 279/2.07; 242/530.3

[58] Field of Search ..... 242/530.3, 545.1, 242/576.1, 422.4; 279/2.06, 2.07, 4.11

[56] References Cited

U.S. PATENT DOCUMENTS

| | | | |
|---|---|---|---|
| 4,026,491 | 5/1977 | Bostroem | 242/530.3 |
| 4,209,138 | 6/1980 | Cecchi | 242/530.3 |
| 4,218,029 | 8/1980 | Schwenzfeifer et al. | 242/530.3 |
| 5,375,791 | 12/1994 | Kline et al. | 279/2.07 |

FOREIGN PATENT DOCUMENTS

| | | | |
|---|---|---|---|
| 62-21653 | 1/1987 | Japan | 242/530.3 |
| 63-87460 | 4/1988 | Japan | 242/576.1 |

*Primary Examiner*—John M. Jillions

*Attorney, Agent, or Firm*—Frishauf, Holtz, Goodman, Langer & Chick

[57] ABSTRACT

A rewinding shaft of a slitting machine includes a rewinding shaft having a hollow interior extending axially, the hollow interior being exposed outside at one end of the rewinding shaft; a plurality of cylinder bores formed in an outer peripheral surface of the rewinding shaft and terminating in the hollow interior; a plurality of pistons respectively received in the cylinder bores, such that heads of the pistons can be reciprocally moved in and out of the cylinder bores by pressurized liquid or gas fed to the hollow interior; and at least one rewinding ring removably mounted on the rewinding shaft such that an inner peripheral surface of the rewinding ring can contact the piston heads.

13 Claims, 8 Drawing Sheets

REWINDING SHAFT OF SLITTING MACHINE

BACKGROUND OF THE INVENTION

1. Filed of the Invention

This invention relates to a rewinding shaft of a slitting machine, and more particularly to a rewinding shaft of a slitting machine used for cutting or slitting lengthwise a flexible elongated material, especially a sheet metal, into strips having different widths.

2. Brief Description of the Prior Art

In a typical conventional slitting machine, a rolled raw material is fed by a feeder, then slit into strips having a desired width or widths by a cutter at one stage of the process for feeding the material, and then rewound on a rewinding shaft. For rewinding the required number of strips, a corresponding number of rewinding drums are locked to only one rewinding shaft by suitable means such as a key so that the drums are prevented from slipping and thereafter, the strips are fixedly rewound on the rewinding drums.

However, this prior art has the following problems. First, burrs are usually generated on the edge of the slit materials (strips). When the strips with burrs are simultaneously rewound on the same rewinding shaft, each strip is subjected to different tensions because each strip has a different diameter due to difference in thickness of the burrs. Therefore, the strips rewound on the rewinding shaft (i.e., coils of the strips on the rewinding shaft) tend to get loosened. In order to retighten each coil of the strips, the coils of the strips, which were once rewound on the rewinding shaft, are removed from the shaft and retightened using suitable tools. During the process of this retightening operation, the strips (i.e., coils) often get scratched to thereby degrade their quality. Also, the retightening of the strips is a troublesome and hard work. There is known a looping method as one way for preventing the loosening. In this looping method, the strips are pressed hard by pads or the like immediate before the rewinding shaft. When a large driving force is applied to the rewinding shaft, the strips are rewound in their tightened states on the rewinding shaft under the effect of a drawing phenomenon against the braking force exerted by the pads immediately before the rewinding shaft. However, the strips having a reduced diameter due to a difference in thickness of the burrs which are not the same in rewinding length to other strips and tend to hang down immediate before the pads. This hanging amount of each strip is increased in proportion to the increased rewinding length thereof. As a countermeasure, a deep hole extending more than ten meters is formed in the surface of the earth to receive the hanging portions of the strips. Therefore, the installing costs of the slitting machine are increased and a very large installation space is required. In addition, the strips are liable to get scratched under the effect of the drawing phenomenon caused by the pressing of the pads.

SUMMARY OF THE INVENTION

The present invention has been accomplished in view of the above problems inherent in the prior art. It is, therefore, a general object of the present invention to provide, in order to resolve the above problem, a rewinding shaft of a slitting machine, in which a plurality of elongated materials (i.e., strips) can be simultaneously rewound with a constant tension and without being allowed to hang down at one end thereof.

To achieve the above object, there is essentially provided a rewinding shaft of a slitting machine comprising a rewinding shaft body having a hollow interior extending axially, the hollow interior being exposed outside at one end of the rewinding shaft body; a plurality of cylinder bores formed in an outer peripheral surface of the rewinding shaft body and terminating in the hollow interior; a plurality of pistons respectively received in the cylinder bores, such that heads of the pistons can be reciprocally moved in and out of the cylinder bores by pressurized liquid or gas body fed to the hollow interior; and at least one rewinding ring removably mounted on the rewinding shaft body such that an inner peripheral surface of the rewinding ring can contact the piston heads. Preferably, the openings of the cylinder bores are arranged in a spiral pattern on the outer peripheral surface of the rewinding shaft body. Each piston may be provided with an O-ring.

With the above construction, the pistons are operated to press the rewinding rings from their inner peripheral surface by pressure such as oil pressure, during rotation of the rewinding shaft. When the rewinding tension of the strips, whose rewinding diameter (i.e., coil diameter) became larger than others due to larger burrs formed thereon, is increased, the rewinding rings slip against the braking frictional force between the pistons and the rewinding rings and as a result, the rewinding operation is temporarily stopped. However, the rewinding operation for the other strips whose rewinding tension is relatively weak is continued. Here, when the rewinding tension of those strips, for which the rewinding operation has been temporarily stopped, is reduced to the level of the other strips, the rewinding rings, which are in the slipped position, are rotated again by the braking force to resume the rewinding operation. This procedure is repeatedly performed to each strip.

The novel features which are considered characteristic of this invention are set out in the appended claims. The invention itself, however, together with additional objects and advantages thereof will be best understood from the following detailed description taken in conjunction with the accompanying drawings which illustrate, by way of example only, a preferred embodiment of this invention.

DETAILED DESCRIPTION OF THE EMBODIMENT

One embodiment of the present invention will now be described with reference to the accompanying drawings. It should be noted, however, that the embodiment herein described is not intended to be exhaustive or to limit the invention to the precise form disclosed. It is chosen and described to explain the principles of the invention, its application and its practical use to enable others skilled in the art to utilize the invention.

Figure 10:
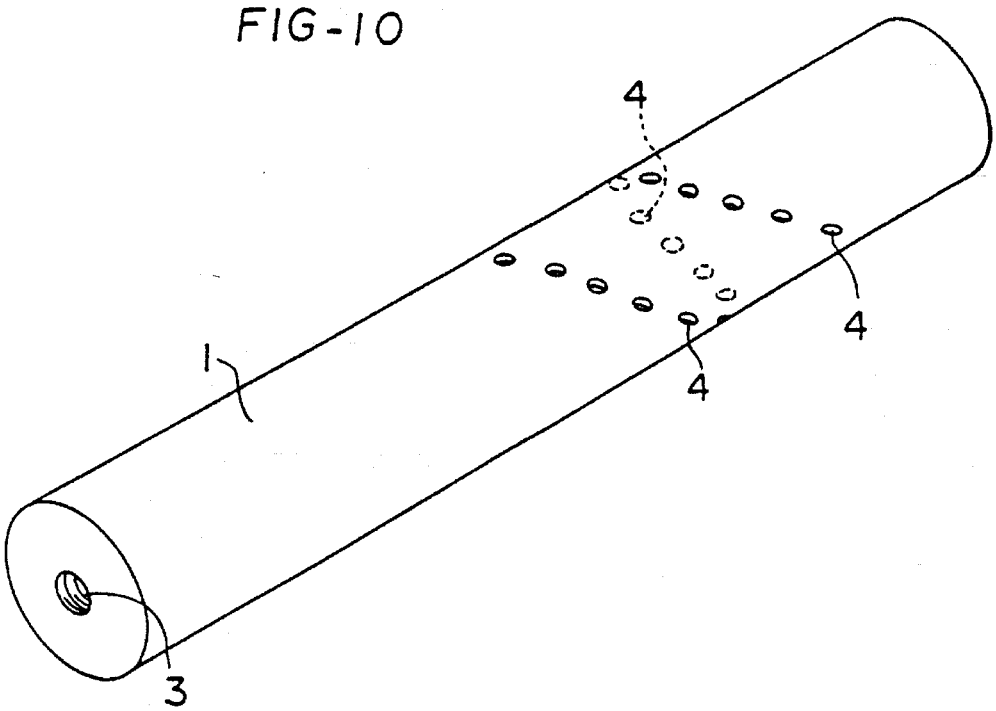
FIG. 10 is a perspective view of a rewinding shaft body.

In those Figures, reference numeral 1 denotes a rewinding shaft body. The rewinding body 1 has a linear hollow 2 interior formed axially therein. The hollow interior 2 is exposed outside at one end thereof. The inner peripheral surface of the rewinding body 1, which defines the hollow interior 2, is internally threaded at 3 on that end portion side where the hollow interior 2 is exposed outside. As shown in FIG. 10, cylinder bores 4 are formed in the rewinding shaft body 1 such that openings of the cylinder bores 4 are arranged in a spiral pattern on the outer peripheral surface of the rewinding shaft body 1. The cylinder bores 4 are perpendicularly communicated with the hollow interior 2. Those portions of the cylinder bores 4, which are communicated with the hollow interior 2, are gradually narrowed in the form of an orifice.

Pistons 5 are received in the cylinder bores 4, respectively. Each piston 5 has an O-ring 6 mounted on an outer periphery thereof. The pistons 5 are reciprocally slidingly moved within the cylinder bores 4 by pressure oil fed through an oil pressure line as later described, so that heads of the pistons 5 can be reciprocally moved in and out of the openings of the cylinder bores 4 (the heads are moved in under the effect of negative pressure and moved out under the effect of positive pressure).

Rewinding rings 8 are fitted onto the rewinding shaft body 1 at desired locations thereof, so that the rewinding rings 8 correspond to the strips having a desired width, which strips are formed by cutting an elongated material 15. Since the heads of the pistons 5 are spirally moved out of the cylinder bores 4 due to the arrangement of the cylinder bores 4, they can contact the inner peripheral surface of the rewinding rings 8. For starting the rewinding, one end of each partly slit material 15 (each partly slit material 15 forms, at this stage, only a part of each strip which is to be rewound on the rewinding shaft body 1) is secured to the outer periphery of the rewinding shaft 8 by suitable adhesive means such as an adhesive tape.

Figure 1:
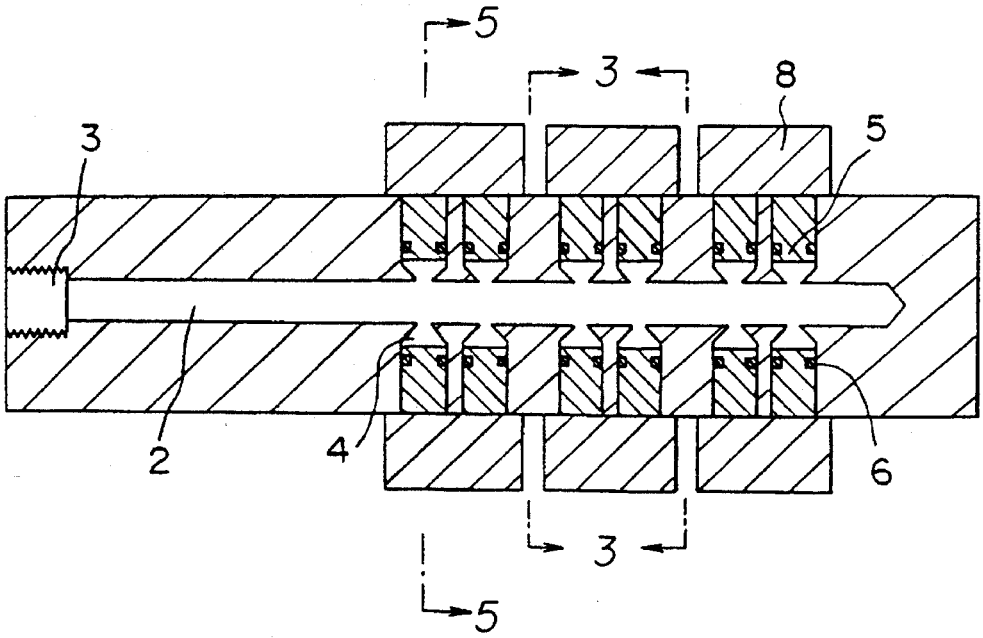
FIG. 1 is a vertical sectional view of a rewinding shaft incorporated with the present invention.
Figure 2:
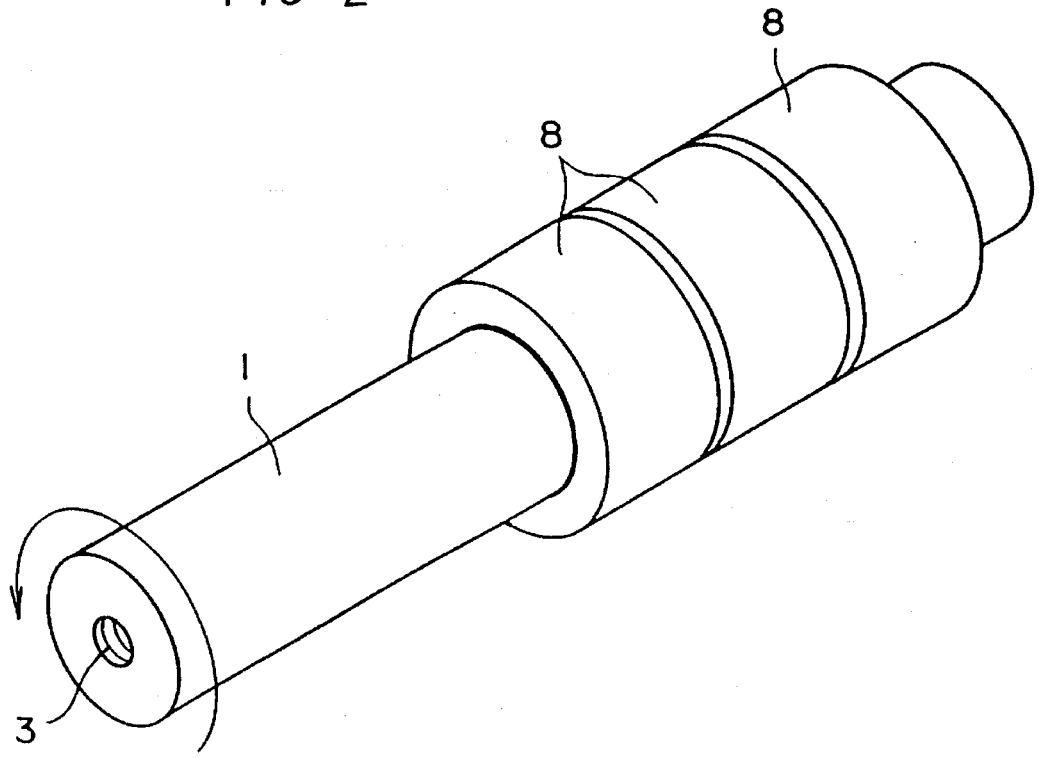
FIG. 2 is a perspective view of the rewinding shaft of FIG. 1.
Figure 3:
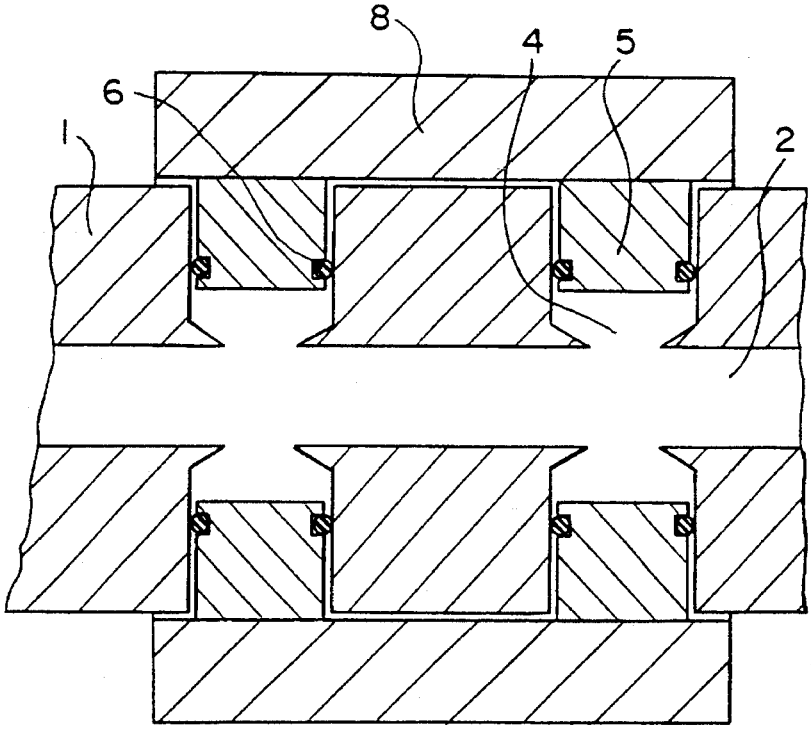
FIG. 3 is an enlarged cross-sectional view taken on line 3—3 of FIG. 1 and viewed in the direction as shown by arrows, in which the heads of pistons are in pressure contact with rewinding rings.
Figure 4:
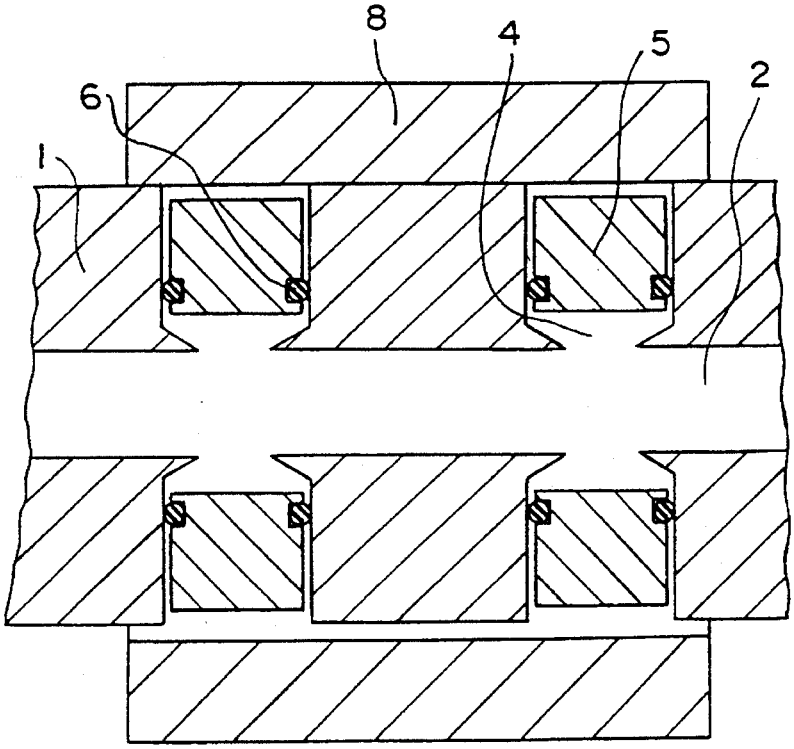
FIG. 4 is likewise an enlarged cross-sectional view, similar to FIG. 3, but in which the heads of pistons are not in pressure contact with rewinding rings.
Figure 5:
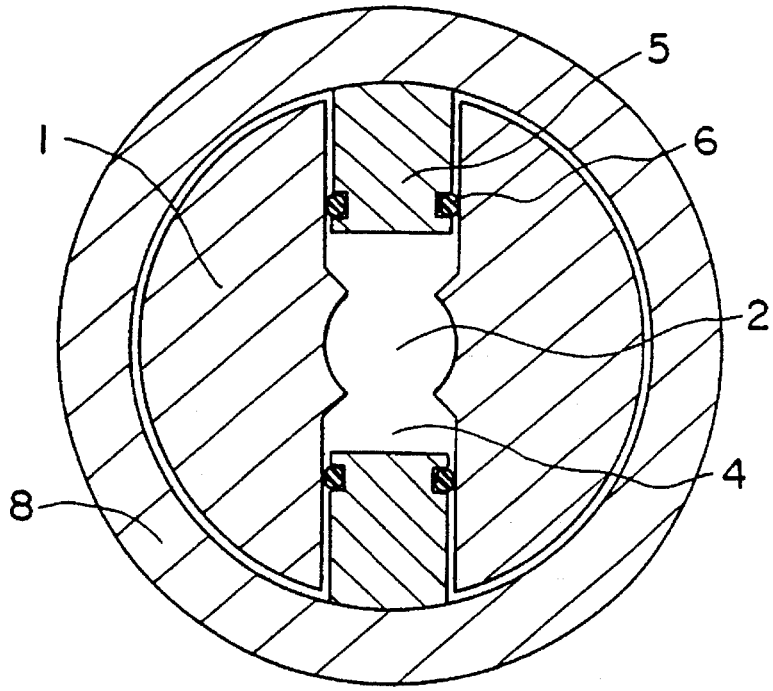
FIG. 5 is an enlarged cross-sectional view taken on line 5—5 of FIG. 1 and viewed in the direction as shown by arrows, in which the heads of pistons are in contact with rewinding rings.
Figure 6:
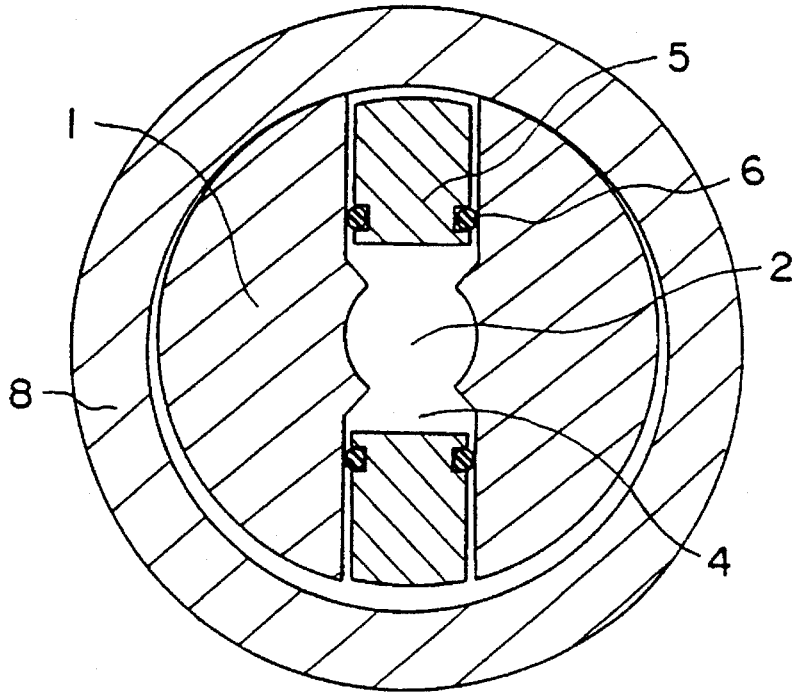
FIG. 6 is likewise an enlarged cross-sectional view, similar to FIG. 5, but in which the heads of pistons are not in contact with rewinding rings.
Figure 7:
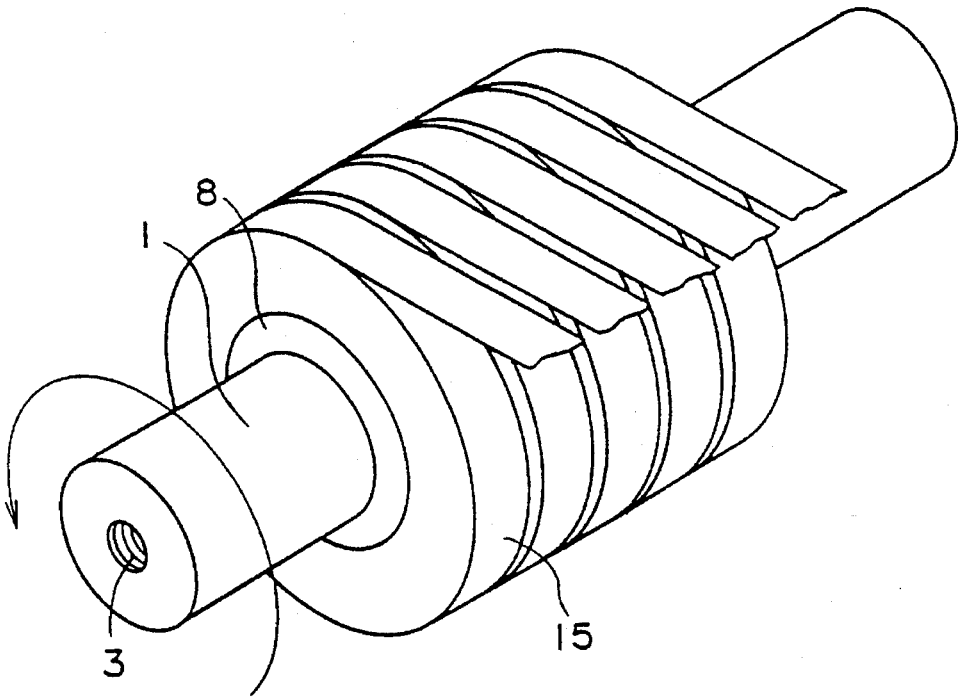
FIG. 7 is a perspective view showing one example of a rewinding shaft and strips rewound on it, according to the present invention.
Figure 8:
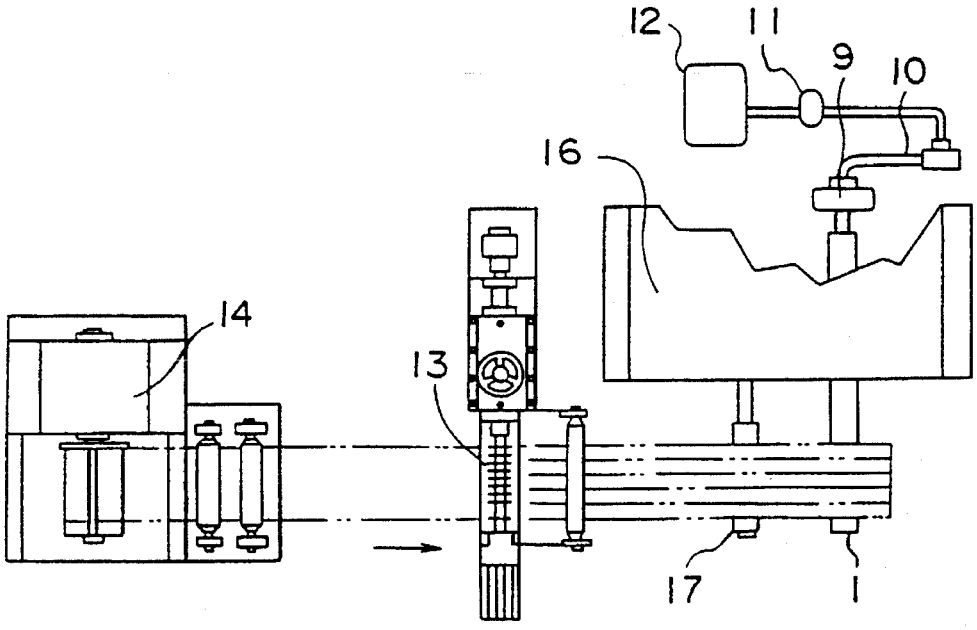
FIG. 8 is a schematic plan view of a slitting machine incorporated with a product (i.e., rewinding shaft) of the present invention.
Figure 9:
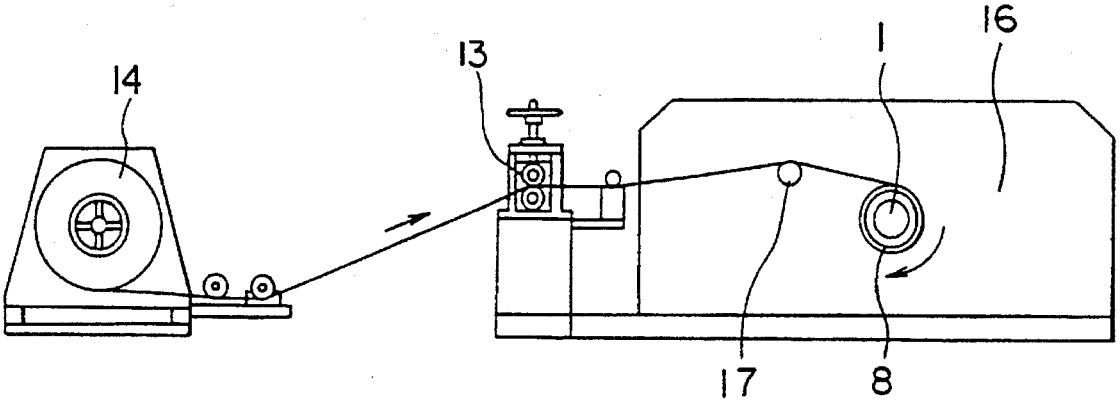
FIG. 9 is a schematic side view of the slitting machine incorporated with a product (i.e., rewinding shaft) of the present invention.

As shown in FIGS. 8 and 9, the rewinding shaft body 1 is carried on a bearing portion 16. An oil pressure line, which comprises a rotary joint 9 connected to a hose 10 leading from a pump 12 via a pressure regulating valve 11, is in turn connected to the internally threaded end 3 of the rewinding shaft body 1, so that oil pressure can be fed into the hollow interior 2. It should be noted here that the projecting amount of each piston 5 can be varied (i.e., pressure to the pressure oil can be varied) by appropriately controlling the rotation of the pump 12, without using the pressure regulating valve 11.

A rewinding apparatus thus constructed is located on and in alignment with the line connecting a material feeder 14 and a slitting portion 13. At the material feeder 14, the material 15 is still in the form of a raw material (sheet of thin metal) having a comparatively large width and wound on a drum. At the slitting portion 13, a wide range of cutter sets (see FIGS. 11 to 23 inclusive) are prepared so that they can be selectively used in accordance with purposes. Such a raw material 14 as mentioned above is cut or slit into strips having a desired width by one of the cutter sets prepared at the slitting portion 13. By rotationally driving the rewinding shaft body 1, the elongated slit material 15 (more strictly, strips) is gradually rewound on the rewinding rings 8 which are braked by the pistons, guided by a roller 17. This embodiment is particularly suited for the use of a sheet of metal having irregular thickness such as an amorphous ribbon.

Figure 11:
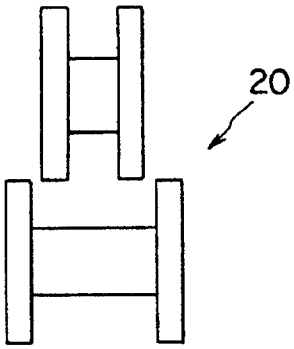
FIG. 11 is a front view showing a basic cutter set.
Figure 12:
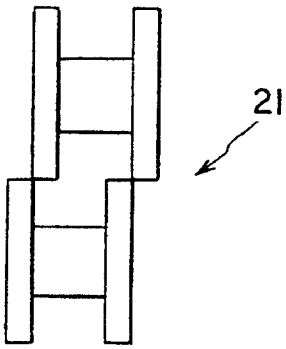
FIG. 12 is likewise a front view showing a cutter set for cutting a thin material in general.
Figure 13:
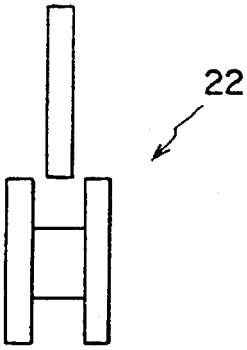
FIG. 13 is likewise a front view showing a cutter set for cutting a narrow material in general.
Figure 14:
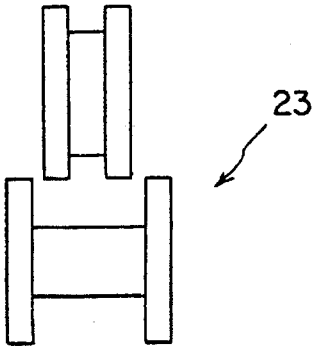
FIG. 14 is likewise a front view showing a cutter set for cutting a narrow material which is heavily snaked.
Figure 15:
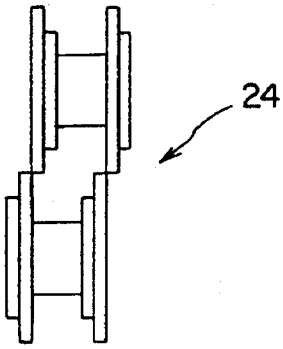
FIG. 15 is likewise a front view showing a modified example of a cutter set for cutting a thin material.
Figure 16:
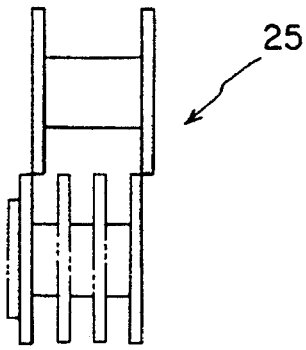
FIG. 16 is likewise a front view showing another modified example of a cutter set for cutting a thin material.
Figure 17:
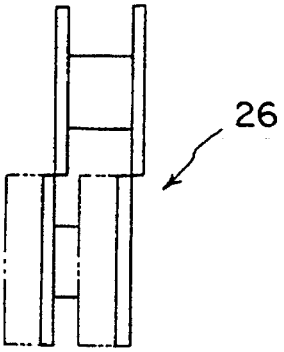
FIG. 17 is likewise a front view showing a further modified example of a cutter set for cutting a thin material.
Figure 18:
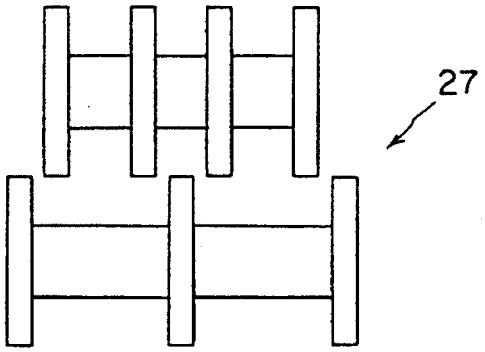
FIG. 18 is likewise a front view showing a cutter set for removing iirregularities of burrs.
Figure 19:
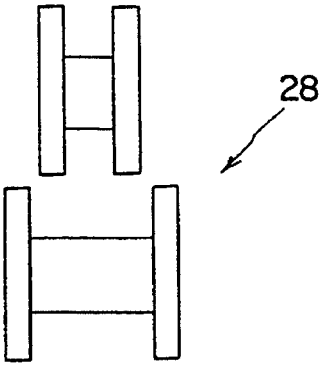
FIG. 19 is likewise a front view showing a cutter set for cutting a thick material.
Figure 20:
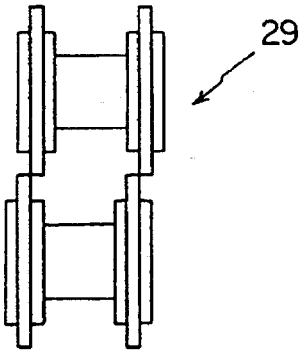
FIG. 20 is likewise a front view showing a cutter set for cutting a foil material.
Figure 21:
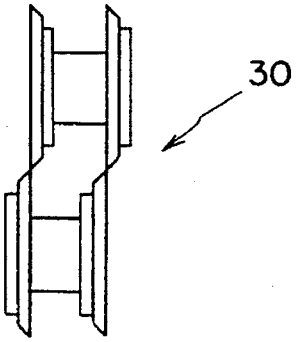
FIG. 21 is likewise a front view showing a modified example of a cutter set for cutting a foil material.
Figure 22:
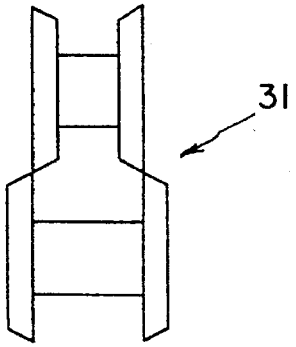
FIG. 22 is likewise a front view showing another modified example of a cutter set for cutting a foil material.
Figure 23:
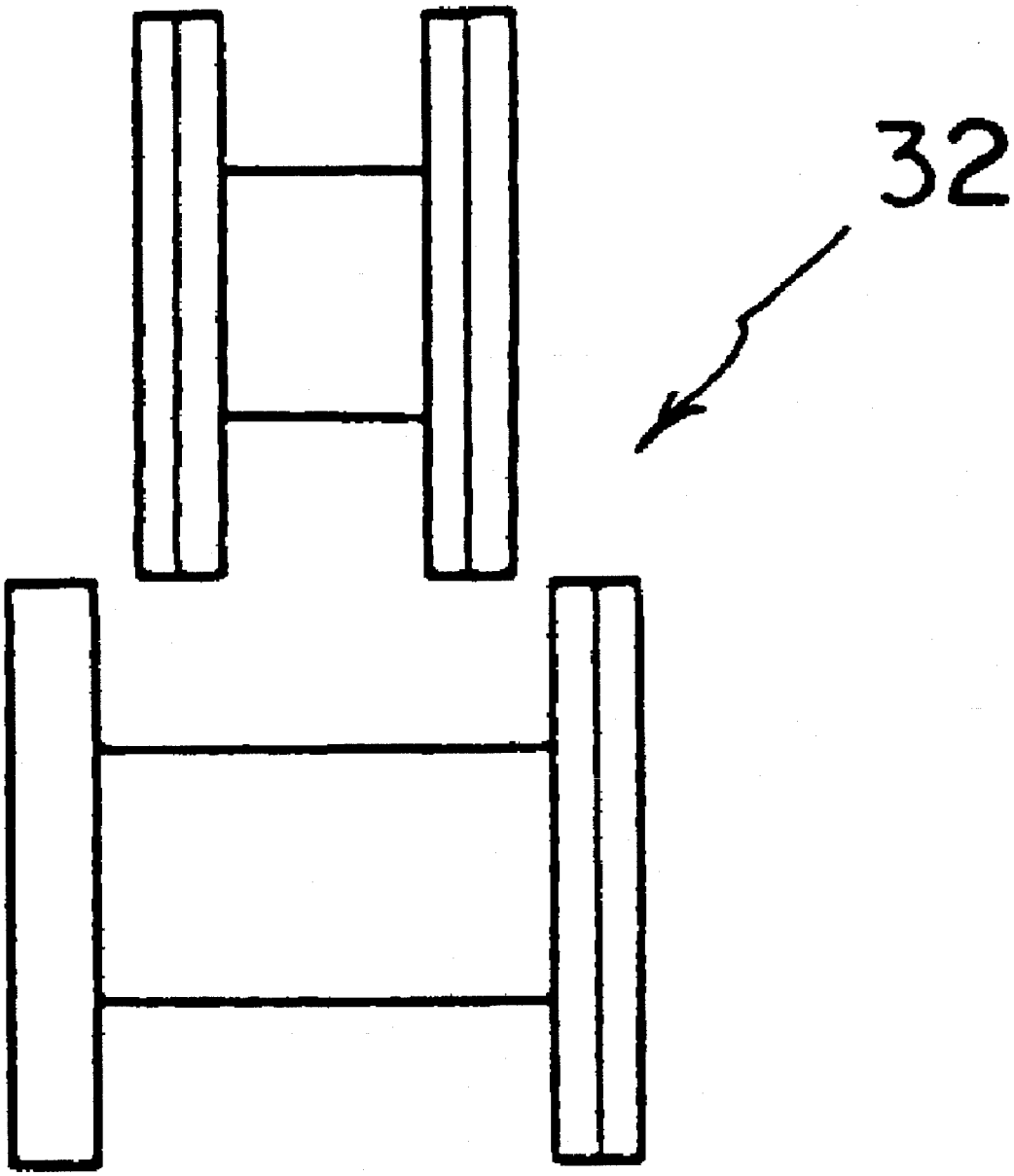
FIG. 23 is likewise a front view showing a cutter set provided with cutter-mark preventive tapes.

FIG. 11 shows a basic cutter set 20 of slitting portion 13. Modified cutter sets 21 and 24–26 are shown in FIGS. 12 and 15–17, respectively, for cutting a thin material. A further modified cutter set 22 is shown in FIG. 13 for cutting a narrow material. A still further modified cutter set 23 is shown in FIG. 14 for cutting a narrow material which is heavily snaked. A yet further modified cutter set 27 is shown in FIG. 18 for removing irregularities of burrs. Another modified cutter set 28 is shown in FIG. 19 for cutting a thick material. Modified cutter sets 29–31 are shown in FIGS. 20–22, respectively, for cutting a foil material. Finally, a cutter set 32 is shown in FIG. 23 with cutter-mark preventive tapes.

When oil regulated at predetermined pressure by the pressure regulating valve 11 is fed to the hollow interior 2 from the pump 12 through the rotary joint 9, the pistons 5 are all caused to project the heads out of the cylinder bores 4 so that the heads press the rewinding rings 8 from the inner side. As a result, braking force caused by friction acts on the rewinding rings 8. This frictional force is established by means of rotational control of the pump 12 and also by the pressure regulating valve 11, and is variable.

In the alternative, the rewinding shaft body 1 of this embodiment may be fixedly carried on a bearing portion of the material feeder 14. With this arrangement, when the raw material drum is mounted on the rewinding ring 8, the material can be fed in a state ready to be braked, where necessary.

A rewinding shaft of a slitting machine according to the present invention is constructed and operated in the manner as mentioned above. Accordingly, a plurality of elongated materials (i.e., strips) having different diameters due to irregular thickness of the burrs generated during the slitting process and the raw material can be simultaneously rewound on the same shaft with a constant rewinding tension. In addition, since the controlling can be performed in an automatic manner solely by pressure and without a need of provision of an electronic system, the rewinding shaft is less susceptible to trouble and can fulfill a wide range of requirements. Furthermore, since the retightening, loop hole, etc. are no more required, labor can be saved, and scratching and elongation of the material can be eliminated, thus enabling to improve the quality.

Although the present invention has been described in its preferred form with a certain degree of particularity, it is understood that the present disclosure of the preferred form has been made only by way of example and that numerous changes in the details of construction and arrangement of parts may be resorted to without departing from the spirit and the scope of the invention as hereinafter claimed.

What is claimed is:

1. A rewinding shaft of a slitting machine comprising:

(a) a rewinding shaft including a single piece, integral and unitary cylindrical body having a hollow interior extending axially, said hollow interior being exposed outside at one end of said rewinding shaft;

(b) a plurality of cylinder bores extending radially through said cylindrical body such that one end of each bore is formed in an outer peripheral surface of said rewinding shaft and an opposite end of each bore terminates in said hollow interior;

(c) a plurality of pistons respectively received in said cylinder bores in said cylindrical body, such that heads of said pistons are reciprocally moved in and out of said cylinder bores by pressurized liquid or gas fed to said hollow interior, said pistons being removable from said cylinder bores through said one end thereof; and (d) at least one rewinding ring removably mounted on said rewinding shaft such that an inner peripheral surface of said rewinding ring contacts said piston heads when said piston heads are moved radially out of said bores by said pressurized liquid or gas.

2. A rewinding shaft of a slitting machine as defined in claim 1, in which each of said pistons has an O-ring mounted thereon.

3. A rewinding shaft of a slitting machine as defined in claim 2, in which a pressure oil is fed to said hollow interior.

4. A rewinding shaft of a slitting machine as defined in claim 2, in which a projecting amount of each of said pistons is varied by rotationally controlling a pump.

5. A rewinding shaft of a slitting machine as defined in claim 1, in which a pressure oil is fed to said hollow interior.

6. A rewinding shaft of a slitting machine as defined in claim 5, in which a projecting amount of each of said pistons is varied by rotationally controlling a pump.

7. A rewinding shaft of a slitting machine as defined in claim 1, in which an object to be rewound comprises a metal of an amorphous ribbon, which is irregular in thickness.

8. A rewinding shaft of a slitting machine as defined in claim 7, in which a projecting amount of each of said pistons is varied by rotationally controlling a pump.

9. A rewinding shaft of a slitting machine as defined in claim 1, in which a projecting amount of each of said pistons is varied by rotationally controlling a pump.

10. A rewinding shaft of a slitting machine comprising:

(a) a rewinding shaft including a single piece, integral and unitary cylindrical body having a hollow interior extending axially, said hollow interior being exposed outside at one end of said rewinding shaft;

(b) a plurality of cylinder bores extending radially through said cylindrical body such that one end of each bore is formed in an outer peripheral surface of said rewinding shaft and an opposite end of each bore terminates in said hollow interior, openings at said one end of said cylinder bores are arranged in a spiral pattern on the outer peripheral surface of said rewinding shaft;

(c) a plurality of pistons respectively received in said cylinder bores in said cylindrical body, such that heads of said pistons are reciprocally moved in and out of said cylinder bores by pressurized liquid or gas fed to said hollow interior; and (d) at least one rewinding ring removably mounted on said rewinding shaft such that an inner peripheral surface of said rewinding ring contacts said piston heads when said piston heads are moved radially out of said bores by said pressurized liquid or gas.

11. A rewinding shaft of a slitting machine as defined in claim 10, in which each of said pistons has an O-ring mounted thereon.

12. A rewinding shaft of a slitting machine as defined in claim 10, in which a pressure oil is fed to said hollow interior.

13. A rewinding shaft of a slitting machine as defined in claim 10, in which a projecting amount of each of said pistons is varied by rotationally controlling a pump.

* * * * *